US005550719A

United States Patent [19]

Kuo

[11] Patent Number: 5,550,719

[45] Date of Patent: Aug. 27, 1996

[54] SCREW DRIVER WITH A FLASHLIGHT

[76] Inventor: Shang-Tai Kuo, No. 21 Lane 351 An Chung Road Sec 6, Tainan, Taiwan

[21] Appl. No.: 419,883

[22] Filed: Apr. 11, 1995

[51] Int. Cl.[6] ..... B25B 23/18

[52] U.S. Cl. ..... 362/120; 362/204; 362/206

[58] Field of Search ..... 362/109, 119, 362/120, 202, 204, 205, 206

[56] References Cited

U.S. PATENT DOCUMENTS

| | | | |
|---|---|---|---|
| 3,106,403 | 10/1963 | Kirkman | 362/109 |
| 3,370,163 | 2/1968 | Brill | 362/119 |
| 4,345,305 | 8/1982 | Kolm et al. | 362/202 |
| 4,484,253 | 11/1984 | Roberts | 362/205 |
| 4,905,129 | 2/1990 | Sharrah | 362/206 |
| 5,211,468 | 5/1993 | Jeng | 362/120 |
| 5,211,471 | 5/1993 | Rohrs | 362/206 |

FOREIGN PATENT DOCUMENTS

| | | | |
|---|---|---|---|
| 501478 | 3/1951 | Belgium | 362/120 |
| 842769 | 7/1960 | United Kingdom | 362/120 |

*Primary Examiner*—Denise L. Gromada
*Assistant Examiner*—Alan B. Cariaso
*Attorney, Agent, or Firm*—Pro-Techtor International

[57] ABSTRACT

A screw driver with a flashlight comprising a grip having a driver hole for fixing a driver rod, a lamp base with a negative pole connected with a short wire with a spring to contact the negative pole of a battery and a positive pole connected with a bar, a lamp fixed in the top of the lamp base beside the driver rod, the lamp base fitted in a conducting groove provided lengthwise near a battery chamber in the grip, a button switch fixed in a male threaded end portion of a bottom cap, the male threaded portion engaging a female thread in a rear end of the grip to grip to assemble the bottom cap with the grip, and confining the lamp and its related components in the grip, and the button switch located in the bottom cap and able to be touched manually to turn on or off the lamp.

1 Claim, 4 Drawing Sheets

SCREW DRIVER WITH A FLASHLIGHT

BACKGROUND OF THE INVENTION

This inventoin concerns a screw driver with a flashlight, particularly one able to shine an object to be screwed by this driver in case of work in a dark spot or in the nighttime.

A known conventional screw driver with a flashlight shown in FIG. 8 has a complicated structure to have a high cost and a disadvantage that a button switch is easily touched to he turned off by rotating a grip in handling.

SUMMARY OF THE INVENTION

This invention has been devised to offer a screw driver with a flashlight improved in its structure to get rid of the disadvantage of the known conventional one.

A screw driver in the present invention comprises a grip for rotating a driver rod fixed on top and containing a lamp with related components for turning on or off the lamp fixed beside the driver rod to shine an object to be screwed by this driver, in case of a dark spot or the nighttime. A button switch is provided in a bottom cap engaging a rear end of the grip, for turning on and off the lamp.

DETAILED DESCRIPTION OF THE INVENTION

Figure 1:
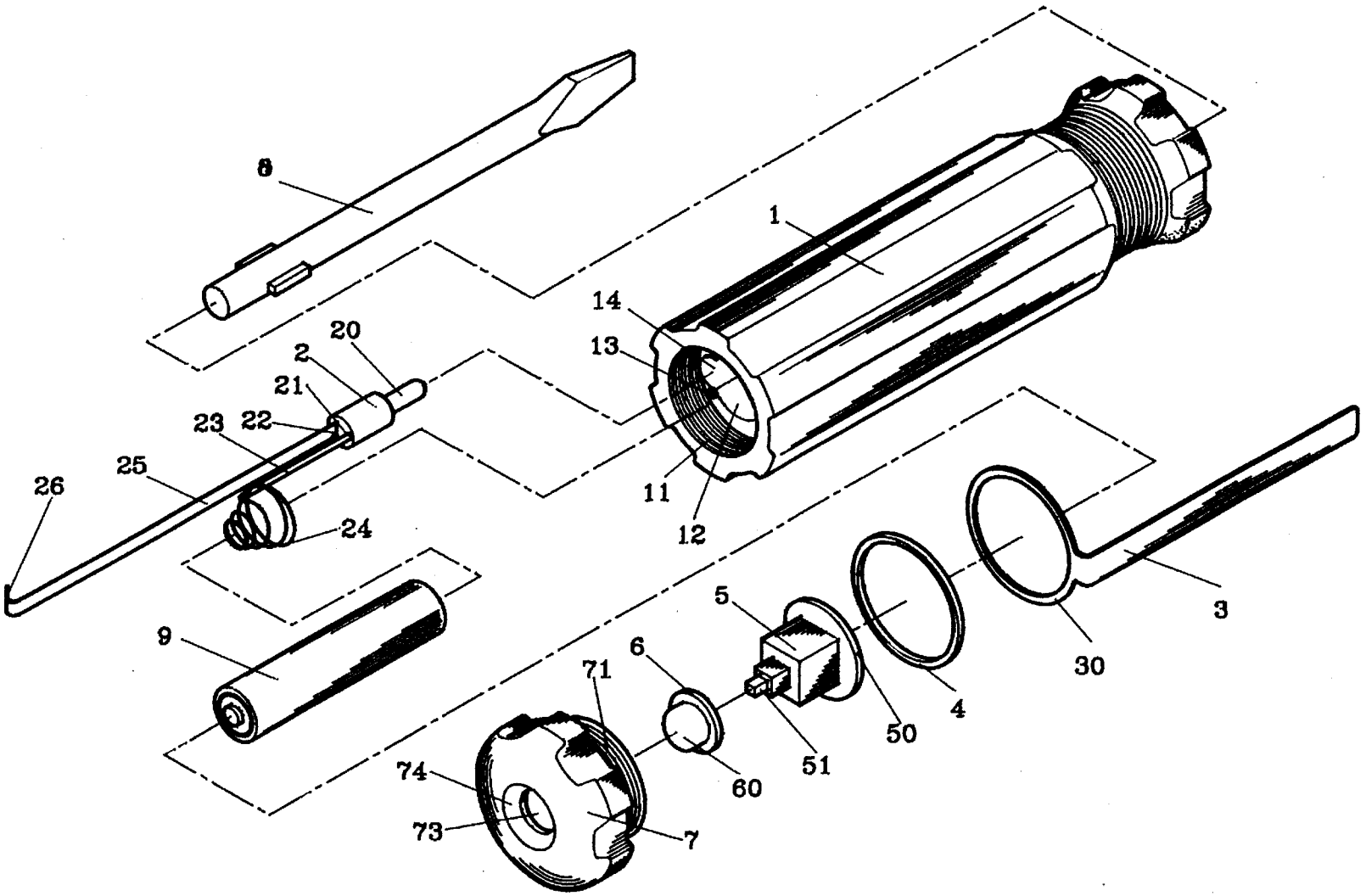
FIG. 1 is an exploded perspective view of a screw driver with a flashlight in the present invention.
Figure 2:
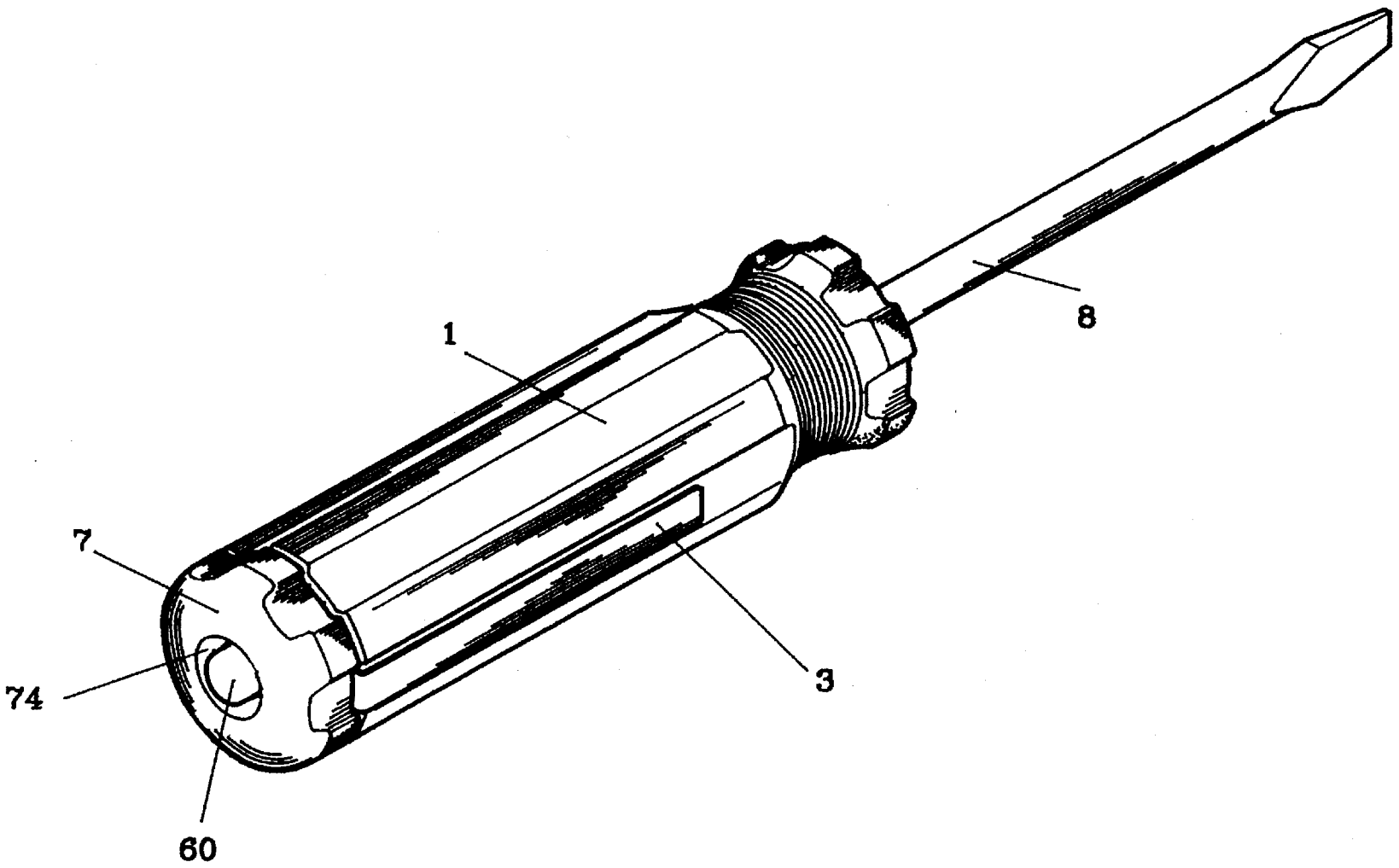
FIG. 2 is a perspective view of the screw driver with a flashlight in the present invention.
Figure 3:
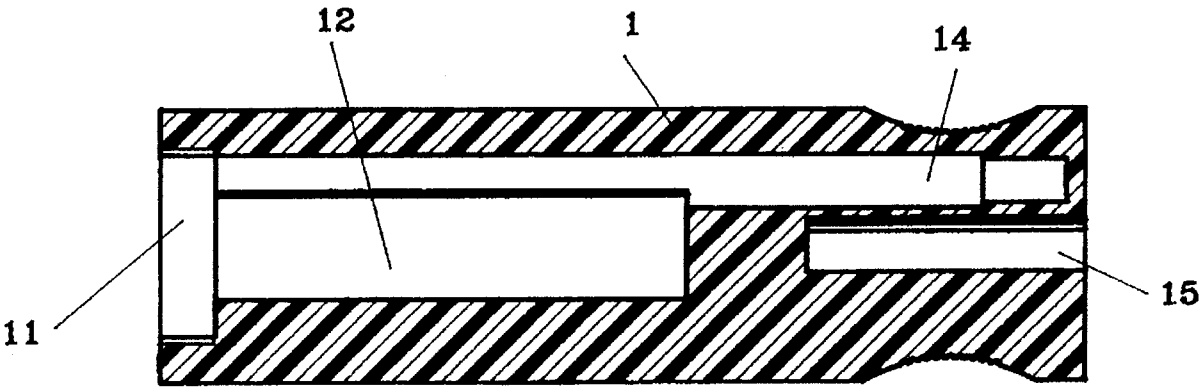
FIG. 3 is a cross-sectional view of a grip of the screw driver with a flashlight in the present invention.
Figure 5:
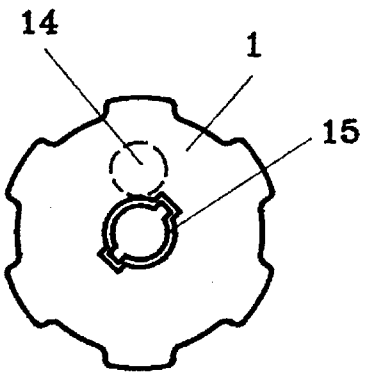
FIG. 5 is a rear view of the grip of the screw driver with a flashlight in the present invention.
Figure 4:
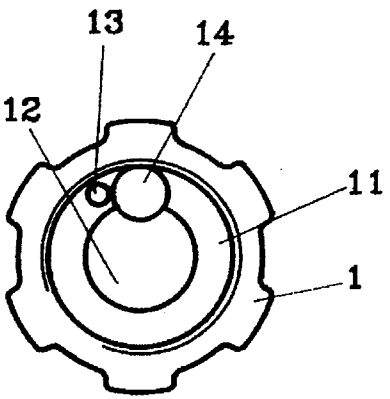
FIG. 4 is a front view of the grip of the screw driver with a flashlight in the present inventoin.
Figure 6:
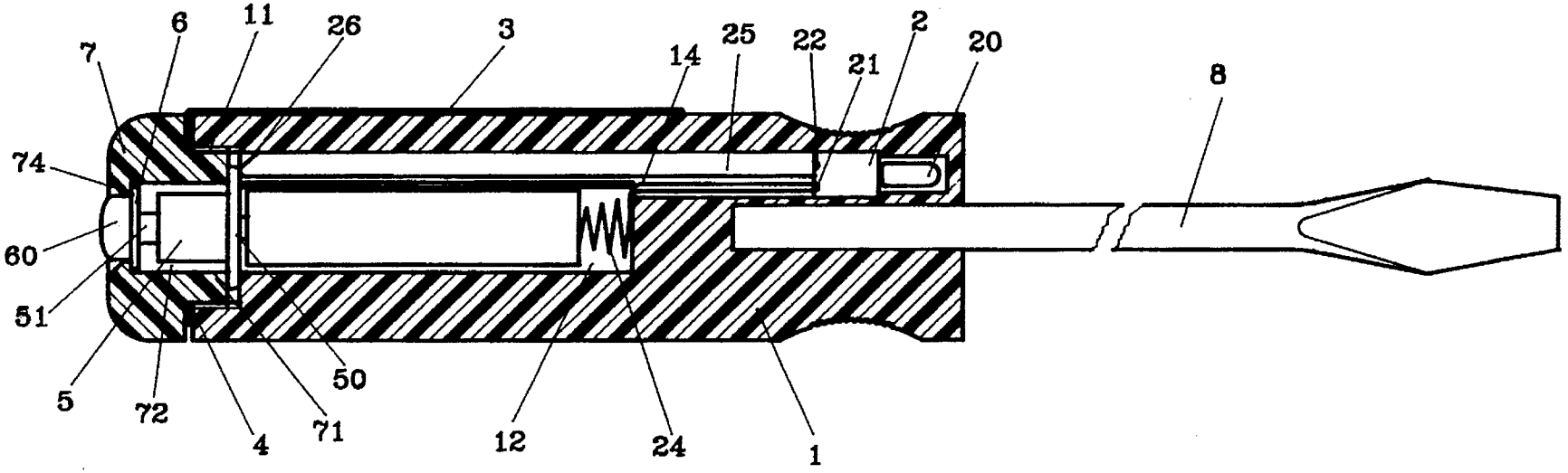
FIG. 6 is a side cross-sectional view of the screw driver with a flashlight in the present invention.
Figure 7:
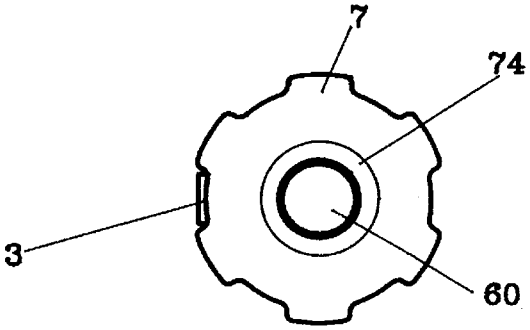
FIG. 7 is a rear view of the screw driver with a flashlight in the present invention.

A screw driver with a flashlight in the present invention, as shown in FIG. 1, comprises a grip 1, a lamp base 2, a hanger 3, a gasket 4, a button switch 5, an inner cap 6, a bottom cap 7, a driver rod 8, and a battery 9 as components combined together.

The grip 1 has an female thread 11 in a bottom end, a battery chamber 12 extending inward from the inner end of the female thread 11, a conducting groove 14 provided lengthwise beside along the battery chamber 12 and extending forward near the top end, a driver rod tube 15 fixed in a front portion beside the conducting groove 13 but not protruding the top end, and a hook hole 13 provided beside the front end of the conducting groove 14.

The lamp base 2 is of a post shape, contained in the conducting groove 14, having its top fixed with a lamp 20, its bottom fixed with a negative pole 21 connected with a short wire 23, a helical spring 24 connected with the top end of the short wire 23 and a positive pole 22 fixed in the bottom end and connected with an elongate conductive bar 25 with a hook 26 at its end to engage with the locating hole 13 of the grip 1.

The hanger 3 has a position ring 30 and an elongate bar fixed with the position ring 30 in a right angle, and the ring 30 fits around a male thread portion 71 of the bottom cap 7, in order to hang this driver on a pocket of a shirt of a user.

The gasket 4 is fitted around a male-threaded end portion 71 of the bottom cap 7, preventing water from flowing into the grip 1.

The button switch 5 is for turning on and off the power of the flashlight, having a button 51 on the bottom and covered in the inner cap 6 and a disc 50 at top to contact with the end of the positive pole 22 of the elongate conductive bar 25, and being contained in a switch hole 72 in the bottom cap 7.

The inner cap 6 is shaped as a cap, being fitted in a through hole 73 of the bottom cap 7, having a cap portion 60 projecting in a sloped hole 74 in a bottom end of the bottom cap, communicating with the through hole 73 and containing the button 51 of the button switch 5.

The bottom cap 7 has a male-threaded inner end portion 71, a switch hole 72 provided in the male-threaded portion 71, a through hole 73 communicating with the switch hole 72 and a sloped hole 74 in an outer end. The through hole 73 is for the cap portion 60 of the inner cap 6 to fit therein, the switch hole 72 is for the button switch 5 to fit therein, and the male-threaded portion 71 engages with the female thread 11 of the grip 1, with the hanger 3 and the gasket 4 fitting around the male-threaded portion 71 and sandwiched between the bottom cap 7 and the grip 1.

The driver rod 8 is fitted in the driver rod tube 15 of the grip 1, having a tip for screwing a screw or a bolt.

The battery 9 has its negative pole elastically urged by the spring 24 and its positive pole contacting with the conducting disc 50 of the button switch 5.

In assembling, the lamp base 2 together with the short wire 23, the spring 24, the elongate conductive bar 25 is pushed upward in the conductive groove 14 of the grip 1 from the bottom of the grip 1, with the spring 24 reaching an upper wall of the battery chamber 12, with the hook 26 of the conductive bar 25 engaging the location hole 13 of the grip 1, and with the lamp 20 located near the top of the grip 1. Then the battery 9 is placed in the battery chamber 12, urged by the spring 24, the inner cap 6 and the button switch 5 are placed in the bottom cap 7. The hanger 3 and the gasket 4 are fitted around the threaded portion 71 of the bottom cap, and the male-threaded portion 71 is screwed with the female thread 11 of the grip 1, with the hanger 3 and the gasket sandwiched between the bottom cap 7 and the grip 1.

After the screw driver with a flashlight is assembled together, the lamp 20 can be lit up by pushing the button of the button switch for shining an object to be driven by this driver at night. Besides, the button switch 5 is protected by the inner cap 6 fitted in the button cap 7, preventing from occasional touching by a user to turn off the switch.

What is claimed is:

1. A screw driver with a flashlight comprising:

a grip having a female thread in a bottom end, a battery chamber extending inward from an inner end of said female thread for placing a battery therein, a conducting groove bored lengthwise beside the battery chamber and extending to near a front end of said grip, but not protruding out of the front end, a driver rod tube beside the conducting groove with an opening on the front end of said grip, and a hook hole near a bottom end of the conducting groove;

a lamp base contained in said conducting groove of said grip, having a negative pole and a positive pole in a bottom end, said negative pole and said positive pole separated from each other, a short wire connected with the negative pole and extending rearward and having its rear end connected with a helical spring, and a conductive elongate bar connected to the positive pole and extending rearward in parallel to the short wire of the negative pole and having a hook at a rear end;

a button switch contained in a switch hole in a bottom cap, having a conducting disc at a top end thereof to contact with the rear end of the elongate bar and a positive pole of a battery;

an inner cap provided to cover a rear end of said button switch;

said bottom cap having a male-threaded inner end portion to engage said female thread of said grip, a center sloped hole provided in a rear end of the cap, said switch hole provided in the male-threaded portion, a through hole communicating with said switch hole and said sloped hole, said through hole fitting with said inner cap firmly, a hangar and a gasket provided to fit around said male-threaded portion and sandwiched between said bottom cap and said rear end of said grip after said bottom cap is combined with said grip; and said lamp base together with said short wire, said helical spring and said elongate conducting bar being placed in said conducting groove of said grip, said helical spring being located in the top end of said battery chamber, said hook of said conducting bar hooking said hook hole, a lamp fixed on top of said lamp base near the front end of said grip, a battery being placed in said battery chamber with a negative bottom in contact with the top of said helical spring, said inner cap and said button switch being placed in the switch hole of said bottom cap, and said male-threaded portion being screwed tightly into the female thread of said grip.

* * * * *